US005152853A

United States Patent [19]

Fleischer

[11] Patent Number: 5,152,853

[45] **Date of Patent: * Oct. 6, 1992**

[54] RUTHENIUM ALUMINUM INTERMETALLIC COMPOUNDS WITH SCANDIUM AND BORON

[75] Inventor: Robert L. Fleischer, Schenectady, N.Y.

[73] Assignee: General Electric Company, Schenectady, N.Y.

[ * ] Notice: The portion of the term of this patent subsequent to Apr. 30, 2008 has been disclaimed.

[21] Appl. No.: 659,812

[22] Filed: Feb. 25, 1991

[51] Int. Cl.[5] ..... C22C 21/00

[52] U.S. Cl. ..... 148/430; 148/437; 420/462; 420/528

[58] Field of Search ..... 148/430, 437; 420/462, 420/528

[56] References Cited

U.S. PATENT DOCUMENTS 5,011,554 4/1991 Fleischer ..... 148/430

FOREIGN PATENT DOCUMENTS 2637914 4/1990 France .

*Primary Examiner*—R. Dean

*Assistant Examiner*—Margery S. Phipps

*Attorney, Agent, or Firm*—James E. McGinness; James Magee, Jr.

[57] ABSTRACT

Intermetallic compounds of ruthenium and aluminum are disclosed comprising about 40 to 51 atomic percent aluminum, about 0.8 to 9 atomic percent scandium and boron, and the balance substantially ruthenium. The intermetallic compounds have a high hardness up to about 1150° C., and good room-temperature toughness.

6 Claims, No Drawings

RUTHENIUM ALUMINUM INTERMETALLIC COMPOUNDS WITH SCANDIUM AND BORON

This application is related to copending application Ser. No. 07/457,009, filed Dec. 26, 1989 now U.S. Pat. No. 5,011,554 issued Apr. 30, 1991.

BACKGROUND OF THE INVENTION:

This invention relates to high temperature alloys, and more particularly to intermetallic compounds comprising ruthenium and aluminum, herein referred to as ruthenium aluminides, having high hardness at elevated temperatures and good room-temperature toughness.

Intermetallic compounds are alloys having a simple stoichiometric proportion between the components and having a crystal structure different from the crystal structure of the component elements. The structure of intermetallic compounds is homogeneous over a typically narrow composition range where atoms of each component occupy ordered sites in the crystal lattice. Many intermetallic compounds have been studied because of their potential for use at elevated temperatures. The compounds can have greater stiffness than the metals from which they are formed, and have higher strength at elevated temperatures as compared to disordered alloys. In many cases low specific gravities give intermetallic compounds a high ratio of stiffness-to-density and strength-to-density, two quantities that are highly desirable in aircraft or rotating parts.

A serious problem in the use of intermetallic compounds comes from their tendency toward brittleness. Brittleness in intermetallic compounds is shown by poor ductility or poor toughness at low temperatures such as room-temperature. Toughness is the ability of a material to absorb impact energy. A result of such brittleness is that many intermetallic compounds cannot be formed extensively and the articles that can be formed are susceptible to damage in their normal use and handling.

A well known intermetallic compound system is the titanium aluminides. Many of the advances from the research of titanium aluminides produced alloys having a reduced tendency toward brittleness while maintaining a high strength at elevated temperatures. For example in U.S. Pat. 4,292,077 to Blackburn et al., trititanium aluminides consisting of about 24–27 atomic percent aluminum, 11–16 atomic percent niobium, and the balance titanium are disclosed as having good high temperature strength with low temperature ductility. The Blackburn alloys are disclosed as being useful at temperatures of about 600° C.

It is well known within the metallurgical art that indentation hardness is an indicator of the yield strength of materials, "The Indentation of Materials by Wedges," Hirst, W., Howse, M.G.J.W., Proceedings of the Royal Society A., Vol. 311, pp. 429–444 (1969). Therefore a comparative determination of the high temperature strength of different materials can be made from comparing the high temperature indentation hardness of the materials.

An object of this invention is to provide improved ruthenium aluminides having high hardness and high strength at temperatures up to about 1150° C., and good toughness at room-temperature.

BRIEF DESCRIPTION OF THE INVENTION

I have discovered improved ruthenium aluminides comprising, about 40 to 51 atomic percent aluminum, about 0.8 to 9 atomic percent scandium and boron, and the balance substantially ruthenium, the intermetallic compounds having a high hardness up to about 1150° C. and good room-temperature toughness. A more preferred range comprises, about 40 to 51 atomic percent aluminum, about 0.3 to 2 atomic percent boron, about 0.5 to 7 atomic percent scandium, and the balance substantially ruthenium. A most preferred range comprises, about 40 to 51 atomic percent aluminum, about 0.5 to 1.5 atomic percent boron, about 2 to 4 atomic percent scandium, and the balance substantially ruthenium. Intermetallic compounds are sometimes abbreviated herein, for example, the abbreviation Ru-42Al-6Sc-0.5B comprises 42 atomic percent aluminum, 6 atomic percent scandium, 0.5 atomic percent boron, and the balance ruthenium.

As used herein, the term "balance substantially ruthenium," means that the ruthenium is the predominant element being greater in weight percent than any other element present in the alloy. However, other elements which do not interfere with achievement of the high hardness at temperatures up to 1150° C. and good room-temperature impact strength of the intermetallic compounds may be present either as impurities or up to non-interfering levels.

The term "high hardness up to 1150° C.," means the Vickers hardness at a given temperature up to 1150° C. is comparable to the hardness of Ti-24Al-11Nb.

The term "good room-temperature toughness," means the room-temperature toughness is comparable to the room-temperature toughness of Ti-24Al-11Nb.

DETAILED DESCRIPTION OF THE INVENTION

Ruthenium aluminides disclosed herein can be prepared by the processes used for other alloys having high melting temperatures. For example ruthenium aluminides can be melted by arc-melting or induction melting in a copper crucible under a protective atmosphere. Ruthenium aluminides can also be prepared by powder metallurgy techniques, such as, admixing finely comminuted alloying ingredients followed by consolidation through the application of heat and pressure.

Shaped structural articles can be produced by casting the ruthenium aluminide from the molten state. Optionally the casting is hot-isostatically pressed to reduce porosity. Molten ruthenium aluminides can also be rapidly solidified into foils, and the foils consolidated through the application of heat and pressure. Admixed powders of the ruthenium aluminide ingredients can be shaped into articles by pressing and consolidating the pressed article through the application of heat and pressure.

Ruthenium aluminides disclosed herein have a microstructure predominantly of the cesium chloride structure herein referred to as the ordered body-centered cubic structure. The ordered body-centered cubic structure can be described by reference to a simple cube having atoms located at each corner of the cube and one atom at the center, with the corner atoms being one element, for example aluminum, and the atom at the center of the cube a second element, for example ruthenium. The volume fraction of the ordered body-centered cubic structure is at least about 80 percent in the ruthenium aluminides of this invention.

The various features and advantages of the alloys of this invention are further shown by the following Example.

EXAMPLE

Charges of high purity ruthenium and aluminum were melted to form ruthenium aluminide samples having the compositions shown below in Table I. In some samples scandium and boron were added to the melt to form the alloyed compositions shown in Table I. Samples were prepared by arc-melting, casting in chilled copper molds, and heat treating at 1350° C. for 20 hours in argon filled silicon dioxide ampules that included a small piece of yttrium to getter oxygen. The castings were cut and polished into 1.0×0.5×0.5 cm bar samples, and subjected to hardness and compression testing.

Vickers hardness of the samples was measured at room-temperature and at elevated temperatures on a Nikon-GM tester, using a diamond pyramid indenter and a load of 1,000 grams in conformance with ASTM E 92, "Standard Test Method for Vickers Hardness of Metallic Materials," Annual Book of ASTM Standards, Vol. 3.01, 1989. The testing was performed in a vacuum of about $10^{-8}$ atmospheres, or slightly less at the highest temperatures where some outgassing or vaporization of the sample may occur.

A measurement of room-temperature ductility was made on some samples by determining the percentage of plastic strain at the maximum load in compression. Compression testing was performed in conformance with ASTM E 9 "Standard Test Methods of Compression Testing of Metallic Materials at Room Temperature," Annual Book of ASTM Standards, Vol. 3.01, 1989.

A simple measure of room-temperature toughness was performed on the as-cast and annealed samples by a chisel impact test. A steel chisel and a hammer of either 160 grams or 729 grams was used in the impact test. The steel chisel was placed against the sample and struck sharply with one of the hammers. Ratings were developed for the test as follows; 0 is a sample that broke upon cooling after casting or after a light tap of the 160-gram hammer, a 1 rating required repeated sharp blows with the 160-gram hammer to fracture the sample, a 2 rating required repeated sharp blows with the 729-gram hammer to fracture the sample, and samples were given a 3 rating when repeated sharp blows with the 729-gram hammer did not cause fracture of the sample. This test is not a standardized test but gives a relative rating of toughness when samples are tested in the same manner.

The volume fraction of ordered body-centered cubic structure was determined by metallographic inspection of polished samples. The results of the above described tests performed on the ruthenium aluminides prepared in this Example are shown below in Table I.

TABLE I

MECHANICAL PROPERTIES OF RUTHENIUM ALUMINUM INTERMETALLIC COMPOUNDS

| Test No. | Composition Atomic %: Ru | Al | Sc | B | Average Vickers Hardness (kg/mm²) Room Temp. | 950° C. | 1150° C. | Room Temp. Chisel Impact Rating | Compression Percent Strain to Max. Load | Volume Fraction Ordered Body Centered Cubic (%) |
|---|---|---|---|---|---|---|---|---|---|---|
| 1 | 47 | 53 | | | 373 | 198 | 135 | 1 | 0 | 99 |
| 2 | 50 | 50 | | | 311 | 186 | 117 | 3 | 9 | 100 |
| 3 | 51.5 | 48.5 | | | 312 | 142 | 89 | 3 | | 98 |
| 4 | 53 | 47 | | | 286 | 166 | 116 | 3 | >16 | 93 |
| 5 | 54.5 | 45.5 | | | | 151 | 94 | 3* | | 95 |
| 6 | 58 | 42 | | | 362 | 166 | 90 | | | |
| 7 | 60 | 40 | | | 398 | 166 | 89 | | | |
| 8 | 50.6 | 45.9 | 2 | 1.5 | 357 | 259 | 173 | 3 | 34.7 | 84 |
| 9 | 52 | 44 | 4 | 0.5 | 362 | 250 | 167 | 3 | 27.8 | 94 |
| 10 | 52 | 42 | 6 | 0.5 | 395 | 249 | 180 | 2 | 11.6 | 92-97 |
| 11 | 52 | 40 | 8 | 0.5 | 413 | 274 | 169 | 1 | 10.5 | 91 |

*Same impact rating when tested at −196° C.

Table 11 below Contains the Vickers hardness and chisel impact rating from samples of a trititanium aluminide within the composition of the '077 patent discussed above. The trititanium aluminide samples were prepared according to processes well known in the industry to provide optimum properties for Ti-24Al-11Nb alloys.

TABLE II

MECHANICAL PROPERTIES FOR TRITITANIUM ALUMINIDE INTERMETALLIC COMPOUND OF ABOUT Ti—24Al—11Nb

| Average Vickers Hardness (kg/mm²) Room Temp. | 815° C. | Room Temperature Chisel Impact Rating |
|---|---|---|
| 316 | 173 | 2 |

Ruthenium aluminides containing 53 atomic percent aluminum have a high hardness at room and elevated temperatures, but the toughness is poor. For example see test no. 1 having 53 atomic percent aluminum and a chisel impact rating of 1. However when aluminum is less than 53 atomic percent a high hardness is maintained at room and elevated temperatures up to 1150° C. with excellent room-temperature toughness. For example see test nos. 2,3,4, and 5 having from 45.5 to 50 atomic percent aluminum and chisel impact ratings of 3.

When boron and scandium are added to the binary ruthenium aluminide compositions, high temperature hardness is improved while maintaining good room-temperature toughness. Compare tests 6, 7, and 8, alloys having scandium and boron additions, to tests 1-5, alloys having no scandium and boron addition. The samples in tests 6, 7, and 8 have higher high temperature hardness with comparable room-temperature toughness. However, scandium additions of 8 atomic percent or greater adversely affect toughness in ruthenium aluminides comprised of scandium and boron. See test no. 8 where the sample was comprised of 8 atomic percent scandium and had a chisel impact rating of 1. Therefore, scandium is limited to 7 atomic percent when added with boron in the ruthenium aluminides of this invention.

The room-temperature ductility of the ruthenium aluminide samples as shown by the percent of plastic strain to maximum load in compression, is in agreement with the chisel impact ratings. Ruthenium aluminide samples having scandium and boron additions within the ranges of the alloys of this invention have a high percent strain to maximum load. Samples for tests 6 and 7 had the highest percent plastic strain to maximum load of the alloys tested, and contained scandium at 2 and 4 atomic percent, and boron at 1.5 and 0.5 atomic percent respectively.

As discussed above, the trititanium aluminide Ti-24Al-11Nb is known to be a material having high strength at elevated temperatures up to about 600° C. with good low temperature ductility. Since yield strength has been shown to be related to indentation hardness it follows that Ti-24Al-11Nb is a material having good high temperature hardness. The Vickers hardness and chisel impact ratings of the ruthenium aluminide samples in Table I are next compared to the titanium aluminide samples in Table II.

As compared to Ti-24Al-11Nb, the ruthenium aluminides of this invention comprised of scandium and boron have a comparable or higher hardness at low temperatures and elevated temperatures. In fact the ruthenium aluminides of this invention have a higher hardness at 950° C. than the hardness at 815° C. of Ti-24Al-11Nb. Similarly, the room-temperature toughness is comparable or superior in the ruthenium aluminides of this invention as compared to Ti-24Al-11Nb Again, since indentation hardness is related to yield strength and the hardness of the ruthenium aluminides disclosed herein is comparable or superior to Ti-24Al-11Nb it follows that the ruthenium aluminides of this invention have good high temperature strength up to about 1150° C.

Contemplated uses for the ruthenium aluminides disclosed herein include elevated temperature applications such as jet engine components. For example contemplated uses include; compressor wheels or blades, turbine wheels or blades, or more generally for applications requiring lightness in weight and retention of strength at elevated temperatures such as plates, channels, or equivalent structural components, tubes, engine housings, or shrouds.

We claim:

1. An intermetallic compound of ruthenium and aluminum consisting essentially of: about 40 to 51 atomic percent aluminum, about 0.8 to 9 atomic percent scandium and boron, and the balance substantially ruthenium, the intermetallic compound having a high hardness up to about 1150° C. and good room-temperature toughness.

2. The intermetallic compound of claim 1 wherein boron is about 0.3 to 2 atomic percent, and scandium is about 0.5 to 7 atomic percent.

3. The intermetallic compound of claim 1 wherein boron is about 0.5 to 1.5 atomic percent, and scandium is about 2 to 4 atomic percent.

4. A structural member consisting essentially of, an intermediate compound of about 40 to 51 atomic percent aluminum, about 0.8 to 9 atomic percent scandium and boron, and the balance substantially ruthenium, the structural member having a high hardness at elevated temperatures up to about 1150° C. and good room-temperature toughness.

5. The structural member of claim 4 wherein the boron is about 0.3 to 2 atomic percent, and scandium is about 0.5 to 7 atomic percent.

6. The structural member of claim 4 wherein the boron is about 0.5 to 1.5 atomic percent, and scandium is about 2 to 4 atomic percent.

* * * * *